United States Patent [19]

Lindstrom et al.

[11] Patent Number: 4,786,424

[45] Date of Patent: Nov. 22, 1988

[54] AQUEOUS METAL-WORKING COMPOSITION AND PROCESS

[75] Inventors: Merlin R. Lindstrom; Bernard A. Baldwin, both of Bartlesville, Okla.

[73] Assignee: Phillips Petroleum Company, Bartlesville, Okla.

[21] Appl. No.: 804,714

[22] Filed: Dec. 5, 1985

[51] Int. Cl.[4] ..... C10M 135/26

[52] U.S. Cl. ..... 252/41; 252/42; 252/33.6; 252/49.3; 252/49.5; 252/48.6

[58] Field of Search ..... 252/54.6, 49.7, 54.0, 252/51.0, 56 R, 41, 42, 33.6, 49.3, 49.5

[56] References Cited

U.S. PATENT DOCUMENTS

| | | | |
|---|---|---|---|
| 2,223,129 | 11/1940 | Pratton | 252/32 |
| 2,683,119 | 7/1954 | Smith et al. | 252/48.6 |
| 2,884,379 | 4/1959 | Rudel et al. | 252/48.6 |
| 3,436,348 | 4/1969 | Chao et al. | 252/33.6 |
| 3,755,176 | 8/1973 | Kinney | 252/48.6 |
| 4,172,802 | 10/1979 | Rieder | 252/49.3 |
| 4,174,284 | 11/1979 | Borel et al. | 252/48.6 |
| 4,199,460 | 4/1980 | Sumrell et al. | 252/54.6 |
| 4,237,021 | 12/1980 | Andlid et al. | 252/49.5 |
| 4,559,153 | 12/1985 | Baldwin et al. | 252/56 R |

OTHER PUBLICATIONS

Smalheer and Smith, "Lubricant Additives", 1967, pp. 9–11.

Fessendeu R. J. et al., Organic Chemistry, 2nd ed., Boston, Willard Grant Press, 1979, p. 580.

*Primary Examiner*—William R. Dixon, Jr.
*Assistant Examiner*—Ellen McAvoy
*Attorney, Agent, or Firm*—Williams, Phillips & Umphlett

[57] ABSTRACT

Novel metal-working process and aqueous metal-working fluids are provided. The aqueous metal-working fluids contain at least one sodium hydrocarbylthiocarboxylate as an extreme pressure (EP) additive.

23 Claims, No Drawings

AQUEOUS METAL-WORKING COMPOSITION AND PROCESS

BACKGROUND OF THE INVENTION

This invention relates to improved aqueous metal-working compositions. This invention also relates to methods of treating metal surfaces that are to be worked. In one aspect, this invention relates to extreme pressure (EP) additives for aqueous metal-working compositions. In yet another aspect this invention relates to methods for enhancing aqueous metal-working compositions.

Metal working compositions such as used in grinding, machining and cutting require good extreme pressure (EP) lubricating properties. Since the base fluids generally have little EP character, this property is provided by the use of additives.

Other important characteristics of metal-working compositions are provided by other additives so that, typically, the composition will contain small amounts of at least one of EP lubricating additive, pH buffer additive, corrosion (rust) inhibitor, surfactant, and biocide among others. Among the components that make up a metal-working composition it is the extreme pressure agent that provides the composition with the definite character of a lubricant for cutting, grinding or machining metal. The present invention provides an EP agent that is effective and compatible with other commonly used components.

It is, therefore, an object of this invention to provide a metal-working composition containing an effective extreme pressure lubricating agent. It is another object of this invention to provide a method for enhancing extreme pressure lubricating properties of a metal-working composition by the addition of a specific additive.

Other objects, aspects, as well as the several advantages of the invention will be apparent to those skilled in the art upon reading the specification and the appended claims.

SUMMARY OF THE INVENTION

In accordance with the invention an aqueous metal-working composition is provided containing at least one alkali metal hydrocarbylthiocarboxylate.

In accordance with another embodiment of the invention, a method is provided for enhancing the extreme pressure lubricating properties of an aqueous metal-working composition by admixing therein an effective amount of at least one alkali metal hydrocarbylthiocarboxylate.

In accordance with still another embodiment of the invention, a method is provided for the treatment of metal surfaces with aqueous metal-working fluids containing at least one alkali metal hydrocarbylthiocarboxylate.

In its broadest aspect the invention provides an effective metal-working composition, a method for improving the effectiveness of metal-working compositions and a method for the treatment of metal surfaces.

DESCRIPTION OF SPECIFIC EMBODIMENT

The preferred alkali metal hydrocarbylthiocarboxylate is a sodium hydrocarbylthiocarboxylate.

The sodium hydrocarbylthiocarboxylates useful as additives in the present invention can be prepared by the addition of NaOH to the carboxylic acid thereby producing a compound of the present invention.

The sodium hydrocarbylthiocarboxylate compounds particularly useful within the context of this invention can be represented by the generalized formula $$R—S—R'CO_2Na$$

or $$[—R—S—R'CO_2Na]_2$$

wherein R is an aryl, alkyl or alkylene of from 1 to about 20 carbon atoms and R' is an alkyl or alkylene of from 1 to about 6 carbon atoms.

Examples of compounds useful in the present invention are:

sodium n-butylthioacetate($n\text{-}C_4H_9—S—CH_2CO_2Na$),
sodium t-butylthioacetate($t—C_4H_9—S—CH_2CO_2Na$),
sodium benzylthioacetate($C_6H_5CH_2—S—CH_2CO_2Na$),
sodium n-dodecylthioacetate($n\text{-}C_{12}H_{25}—S—CH_2CO_2Na$),
sodium n-octylthiopropionate($n\text{-}C_8H_{17}—S—C_2H_4CO_2Na$),
sodium isopropylthioacetate($i\text{-}C_3H_7—S—CH_2CO_2Na$),
3,8-dithiodecanedioate($[—C_2H_4—S—CH_2CO_2Na]_2$),
3,6-dithiooctondioate($[—CH_2—S—CH_2CO_2Na]_2$),
and the like and mixtures thereof.

Sodium hydrocarbythiocarboxylates are effectively used as an extreme pressure agent in metal working compositions in relatively small amounts. Any amount of additive that is sufficient to increase extreme pressure or load bearing properties to the metal-working composition is considered useful for this invention.

The metal-working compositions are best prepared as concentrate containing an effective amount up to about 15 weight percent, preferably from about 5 to about 10 weight percent of the additive in an aqueous medium. In actual use the concentrate is diluted with additional water in an amount and a range of about 5:1 to about 40:1 to water to concentrate depending upon the type of metal work in which the composition is being used. The concentration of the EP additive in the final metal-working composition will be in the range of about 0.1 to about 3.0 weight percent.

The metal-working composition will typically contain effective amounts of compounds useful for increasing lubricity, adjusting pH, inhibiting corrosion, acting as biocide, acting as surfactant or to give other useful properties to the composition. When these components are present in the concentrated composition an effective amount will generally fall within the range of about 5 to about 10 weight percent lubricity additive, about 0.5 to about 10 weight percent pH adjusting compound, about 1 to about 5 weight percent corrosion inhibitor, and about 0.10 to about one weight percent biocide.

Note that upon dilution of the concentrated metal-working composition that a preferred range of additive concentration will follow the range of about 0.1–3.0 weight percent for the EP additive of this invention, about 0.1–2.0 weight percent for lubricity additive, about 0.01–2.0 weight percent for pH adjusting compound, about 0.02–1.0 weight percent for corrosion inhibitor and about 0.002–0.2 weight percent for biocide.

In addition to these other additives the metal working fluid can also contain a surfactant. Preferably the surfactant is in the range of about 0.1 to about 2.0 weight percent based on the total working fluid.

The most preferred concentration of additives in weight percent is at least about 0.1 for corrosion inhibitor, 0.05 for pH adjusting compound and 0.5 for lubricity additive.

The preferred pH adjusting compound is triethanolamine, the preferred lubricity additive is polypropylene glycol and the preferred corrosion inhibitor is octanoic acid (octanoic acid also adds some lubricity).

The preparation of the compositions of this invention is by the admixing of additives in aqueous solution in any order of additives required for a particular purpose. All components are water soluble and, in fact, aside from the Ep additives of this invention, other components of the metal-working composition can be chosen from any of the compounds well-known in the art to be useful and effective for providing specific, desirable properties to the metal-working composition. The specific choice of other components of the composition is not critical to the present invention.

The aqueous compositions of the present invention can be used in methods for shaping metal with a working tool by lubricating the tool and/or the metal. These shaping processes comprise cutting, grinding, drilling, punching, stamping, turning, lapping, polishing, rolling, drawing, and combinations of said processes.. The metal piece can comprise at least one ferrous or at least one non-ferrous metal or a combination of both.

The effectiveness of the herein-described sodium hydrocarbylthiocarboxylate containing aqueous metal working fluids is demonstrated by the following examples. These examples should be taken as illustrative and not as restrictive.

In the following examples a base concentrate of metal-working composition was prepared generally using distilled water and various additives useful for specific purposes. Among the additives used were the following:

sodium n-butylthioacetate and sodium benzylthioacetate extreme pressure agents of this invention, triethanol amine, a pH adjusting compound available from Aldrich Chemical Co., Milwaukee, Wisc., polypropylene glycol 400 MW, a lubricity additive available from Polysciences, Inc., Warrington, Pa.

When these specific additives are used, the aqueous metal-working fluid preferably contains at least about 0.05 weight percent triethanolamine, at least about 0.5 weight percent polypropylene glycol, at least about 0.5 weight percent extreme pressure agent, and at least about 80 weight percent distilled water based on the total composition of the metal working fluid.

EXAMPLES

The following illustrates the effectiveness of sodium hydrocarbylthiocarboxylates as an extreme pressure (EP) agents. Aqueous metal-working fluids are compared; a control run with no extreme pressure additives and runs containing different amounts of an extreme pressure additive according to the invention.

The following table lists aqueous metal-working fluids containing 0.076 weight percent triethanolamine, 0.600 weight percent polypropylene glycol 400 MW, and 0 to 2.0 weight percent invention additive, with the balance being distilled water making the total for each run 100 weight percent. The test used was the well known Falex EP test (ASTM D-3233).

TABLE I

| Run | Additive | Weight Percent Additive | Maximum EP Load (lbs) |
|---|---|---|---|
| 1 | None | — | Break-In |
| 2 | sodium n-butyl-thioacetate | 0.5 | 2500+ |
| 3 | sodium n-butyl-thioacetate | 2.0 | 2500+ |
| 4 | sodium benzyl-thioacetate | 0.5 | 2750 |
| 5 | sodium benzyl-thioacetate | 2.0 | 1000 |

2500+ indicates that the lubricant did not fail at 2500 lbs. applied load, which is the limit of the particular instrument used.
2750 was obtained at a different time using a load guage which read to 3000 lbs.
Break-In indicates that the test failed below 250.

It can be seen from the Table that the use of extreme pressure additives of the present invention provided a large increase in the maximum extreme pressure load as compared to the same base metal-working fluid without the extreme pressure additives.

That which is claimed is:

1. A composition comprising an aqueous metal-working fluid and an alkali metal hydrocarbylthiocarboxylate in an amount sufficient to impart extreme pressure lubricating properties to the metal-working fluid wherein the hydrocarbylthiocarboxylate of the alkali metal hydrocarbylthiocarboxylate is selected from the group consisting of:

$$R—S—R'CO_2^{(-)}$$

and $$(—R—S—R'CO_2^{(-)})_2$$

wherein R represents an aryl, alkyl, or alkylene group having 1 to 20 carbon atoms, and R' represents an alkyl or alkylene group having 1 to 6 carbon atoms.

2. A composition according to claim 1 wherein the alkali metal hydrocarbylthiocarboxylate is a sodium hydrocarbylthiocarboxylate and ranges from 0.1 to about 3.0 weight percent based on the total metal-working fluid.

3. A composition of claim 2 wherein the metal-working fluid also contains an effective amount of at least one compound selected from a surfactant, a pH adjusting compound, a corrosion inhibitor and a biocide.

4. A composition according to claim 3 wherein the sodium hydrocarbylthiocarboxylate is selected from sodium n-butylthioacetate and sodium benzylrthioacetate.

5. A composition of claim 3 wherein the metal working fluid contains a surfactant in the range of at least about 0.1 to about 2.0 weight percent based on the total working fluid.

6. A composition of claim 3 wherein the metal working fluid contains a pH adjusting compound in the range of at least about 0.01 to about 2.0 weight percent based on the total working fluid.

7. A composition of claim 3 wherein the metal working fluid contains a corrosion inhibitor in the range of at least about 0.02 to about 1.0 weight percent based on the total working fluid.

8. A composition of claim 3 wherein the metal working fluid contains a biocide in the range of at least about 0.002 to about 0.2 weight percent based on the total working fluid.

9. A composition according to claim 1 wherein the alkali metal hydrocarbylthiocarboxylate is a sodium hydrocarbylthiocarboxylate in the range of about 0.5 to about 2.0 weight percent based on the total working fluid.

10. A composition according to claim 9 wherein the aqueous metal-working fluid also contains at least one additional additive selected from a surfactant in the range of about 0.1 to about 2.0, a lubricity additive in the range of about 0.1 to about 2.0, a pH adjusting compound in the range of about 0.01 to about 2.0, a corrosion inhibitor in the range of about 0.02 to about 1.0, and a biocide in the range of about 0.002 to about 0.2.

11. A composition according to claim 10 wherein the corrosion inhibitor is octanoic acid, the pH adjusting compound is triethanolamine and the lubricity additive is polypropylene glycol.

12. A composition according to claim 9 wherein the aqueous metal-working fluid contains at least about 0.05 weight percent triethynolamine, at least about 0.5 weight percent polypropylene glycol, at least about 0.5 weight percent sodium hydrocarbylthiocarboxylate and at least about 80 weight percent distilled water based on the total composition of the metal working fluid.

13. A composition according to claim 1 wherein the alkali metal hydrocarbylthiocarboxylate is a sodium hydrocarbylthiocarboxylate selected from:

$$R—S—R'CO_2Na$$

and $$[—R—S—R'CO_2Na]_2$$

wherein R is selected from aryl, alkyl or alkylene groups having 1 to 20 carbon atoms, and wherein R′ is selected from alkyl or alkylene groups having from 1 to 6 carbon atoms.

14. A composition according to claim 13 wherein the sodium hydrocarbylthiocarboxylate is selected from sodium n-butylthioacetate and sodium benzylthioacetate in the range of about 0.5 to about 2.0 weight percent based on the total metal working fluid.

15. A method for enhancing the extreme pressure lubricating properties of an aqueous metal-working composition, said method comprising admixing therein an effective extreme pressure lubricating improving amount of at least one alkali metal hydrocarbylthiocarboxylate wherein the hydrocarbylthiocarboxylate of said alkali metal hydrocarbylthiocarboxylate is selected from the group consisting of:

$$R—S—R'CO_2^{(-)}$$

and $$(—R—S—R'CO_2^{(-)})_2$$

wherein R represents an aryl, alkyl, or alkylene group having 1 to 20 carbon atoms, and R′ represents an alkyl or alkylene group having 1 to 6 carbon atoms.

16. A method for enhancing the extreme pressure lubricating properties of an aqueous metal-working composition according to claim 15 wherein the alkali metal hydrocarbylthiocarboxylate is selected from sodium n-butylthioacetate and sodium benzylthioacetate in an amount from about 0.5 to about 2.0 weight percent of the composition.

17. A method in the treatment of metal surfaces with aqueous metal-working fluids during metal cutting, rolling and working operations, comprising applying a sufficient amount of an aqueous fluid according to claim 1 to reduce wear and improve extreme pressure lubrication of the metal.

18. A composition comprising an aqueous metal-working fluid and an alkali metal hydrocarbylthiocarboxylate in an amount sufficient to impart extreme pressure lubricating properties to the metal-working fluid wherein the hydrocarbythiocarboxylate of said alkali metal hydrocarbylthiocarboxylate is selected from:

$$R—S—R'CO_2^{(-)}$$

and $$(—R—S—R'CO_2^{(-)})_2$$

wherein R represents an alkyl or alkylene group having 1 to 20 carbon atoms, and R′ represents an alkyl or alkylene group having 1 to 6 carbon atoms.

19. A composition according to claim 1 wherein said alkali metal hydrocarbylthiocarboxylate is selected from the group consisting of sodium n-butylthioacetate, sodium t-butylthioacetate, sodium benzylthioacetate, sodium n-dodecylthioacetate, sodium n-octylthiopropionate, sodium isopropylthioacetate, disodium 3,8-dithiodecanedioate, disodium 3,6-dithiooctanedioate, and mixtures thereof.

20. A composition according to claim 1 wherein said alkali metal hydrocarbylthiocarboxylate is sodium benzylthioacetate employed in an amount of about 0.5 weight percent of the total composition.

21. A method according to claim 15 wherein said alkali metal hydrocarbylthiocarboxylate is a sodium hydrocarbylthiocarboxylate selected from the group consisting of:

$$R—S—R'CO_2Na$$

and $$(—R—S—R'CO_2Na)_2$$

wherein R represents an aryl, alkyl, or alkylene group having 1 to 20 carbon atoms, and R′ represents an alkyl or alkylene group having 1 to 6 carbon atoms.

22. A method according to claim 21 wherein said sodium hydrocarbylthiocarboxylate is selected from the group consisting of:

$$R—S—R'CO_2Na$$

and $$(—R—S—R'CO_2Na)_2$$

wherein R is selected from alkyl or alkylene groups having 1 to 20 carbon atoms, and wherein R′ is selected from alkyl or alkylene groups having 1 to 6 carbon atoms.

23. A method according to claim 15 wherein the alkali metal hydrocarbylthiocarboxylate is selected from the group consisting of sodium n-butylthioacetate, sodium t-butylthioacetate, sodium benzylthioacetate, sodium n-dodecylthioacetate, sodium n-octylthiopropionate, sodium isopropylthioacetate, disodium 3,8-dithiodecanadioate, disodium 3,6-dithiooctanedioate, and mixtures thereof.

* * * * *

UNITED STATES PATENT AND TRADEMARK OFFICE

CERTIFICATE OF CORRECTION

PATENT NO. : 4,786,424

DATED : November 22, 1988

INVENTOR(S) : Merlin R. Lindstrom; Bernard A. Baldwin, et al

It is certified that error appears in the above–identified patent and that said Letters Patent is hereby corrected as shown below:

ON THE TITLE PAGE:

"Inventor(s)" should read: --- Merlin R. Lindstrom; Bernard A. Baldwin; and Harold W. Mark, all of Bartlesville, Okla. ---.

Signed and Sealed this

Second Day of January, 1990

*Attest:*

JEFFREY M. SAMUELS

*Attesting Officer*

*Acting Commissioner of Patents and Trademarks*